US008068086B2

(12) United States Patent
Moon

(10) Patent No.: US 8,068,086 B2
(45) Date of Patent: Nov. 29, 2011

(54) GAMMA-REFERENCE-VOLTAGE GENERATING CIRCUIT AND APPARATUS FOR GENERATING GAMMA-VOLTAGES AND DISPLAY DEVICE HAVING THE CIRCUIT

(75) Inventor: Hoi-Sik Moon, Gyeonggi-do (KR)

(73) Assignee: Samsung Electronics Co., Ltd. (KR)

( * ) Notice: Subject to any disclaimer, the term of this patent is extended or adjusted under 35 U.S.C. 154(b) by 1039 days.

(21) Appl. No.: 11/706,045

(22) Filed: Feb. 12, 2007

(65) Prior Publication Data

US 2007/0188430 A1 Aug. 16, 2007

(30) Foreign Application Priority Data

Feb. 14, 2006 (KR) ..... 10-2006-0013928

(51) Int. Cl.
*G09G 3/36* (2006.01)

(52) U.S. Cl. ..... 345/101; 345/98

(58) Field of Classification Search ..... 345/204, 345/690, 208–210, 87, 89, 96, 100, 101
See application file for complete search history.

(56) References Cited

U.S. PATENT DOCUMENTS 4,045,791 A * 8/1977 Fukai et al. ..... 345/101
5,250,937 A * 10/1993 Kikuo et al. ..... 345/89
7,375,707 B1 * 5/2008 Lee ..... 345/89
2007/0103412 A1 * 5/2007 Tang et al. ..... 345/87

FOREIGN PATENT DOCUMENTS

KR 10-2001-0026596 A 4/2001

* cited by examiner

*Primary Examiner* — Nitin Patel
(74) *Attorney, Agent, or Firm* — Innovation Counsel LLP

(57) ABSTRACT

A first resistor string provides a plurality of first polarity gamma-reference-voltages. A second resistor string provides a plurality of second polarity gamma-reference-voltages. A first main-thermal compensation section exhibits a resistance value that increases with an increase of temperature. A second main-thermal compensation section has a resistance value that is decreases with an increase of temperature. Thus, gamma-reference-voltages corresponding to white gradation are decreased and gamma-reference-voltages corresponding to black gradation are maintained, so that a deviation of kickback voltage corresponding to the white gradation is decreased.

21 Claims, 9 Drawing Sheets

GAMMA-REFERENCE-VOLTAGE GENERATING CIRCUIT AND APPARATUS FOR GENERATING GAMMA-VOLTAGES AND DISPLAY DEVICE HAVING THE CIRCUIT

CROSS-REFERENCE TO RELATED APPLICATIONS

This application relies for priority upon Korean Patent Application No. 10-2006-0013928 filed on Feb. 14, 2006 and all the benefits accruing thereform under 35 U.S.C. §119, and the contents of which are herein incorporated by reference in its entirety.

BACKGROUND OF THE INVENTION

1. Field of the Invention

The present invention relates to a gamma-reference-voltage generating circuit and an apparatus for generating gamma-voltages and a display device having the circuit. More particularly, the present invention relates to a gamma-reference-voltage generating circuit having a thermal compensation feature, an apparatus for generating gamma-voltages having the gamma-reference-voltage generating circuit and a display device including the gamma-reference-voltage generating circuit.

2. Description of the Related Art

Generally, a liquid crystal display (LCD) device displays an image by providing a pixel with an analog gradation voltage using a thin-film transistor (TFT). The analog gradation voltage is a data voltage that is provided to a data line of the LCD device.

When a gate voltage of a high level is applied to the thin-film transistor, the thin-film transistor is turned-on, so that the data voltage is charged in a pixel that is defined by a liquid crystal capacitor and a storage capacitor. The variation of the voltage difference between the charged data voltage and a common voltage changes the transmittance of the light passing through a liquid crystal layer, and thus desired gradations are displayed.

When the high value of the gate voltage that is applied to a thin-film transistor of the pixel, the pixel voltage reaches the data voltage. However, the pixel voltage drops by as much as a kickback voltage due to parasitic capacitors of the thin-film transistor after the gate voltage becomes low.

The kickback voltage varies significantly depending on the voltage difference between the pixel voltage and the common voltage as well as depending on the pixel voltage itself. It is because the capacitance of the liquid crystal capacitor depends on the voltage across the liquid crystal capacitor due to the dielectric anisotropy of the liquid crystal. Therefore, the liquid crystal capacitance is varied in accordance with a white gradation displaying and a black gradation displaying, so that the kickback voltages corresponded to each gradations is varied.

Due to the difference of kickback voltages of each gradation, when an image corresponding to a new pattern is displayed after a predetermined image is displayed for a long time, this causes a defect in the LCD device referred to as image sticking.

In order to remove the image sticking, for example, a method of decreasing a remaining DC voltage may be used, which is calculating a kickback voltage corresponding to gradations and compensating a gamma using the calculated kickback voltage.

In order to remove the image sticking, for another example, a method of reducing a difference between kickback voltages corresponding to gradations may be used, which is decreasing an absolute value of the kickback voltages.

BRIEF SUMMARY OF THE INVENTION

The present invention provides a gamma-reference-voltage generating circuit that performs a thermal compensating operation, in accordance with a temperature variation, in a variation of a kickback voltage that is relatively high at a white gradation and a variation of a kickback voltage that is relatively low at a black gradation.

The present invention also provides an apparatus for generating a gamma-voltage having the above-mentioned circuit.

The present invention also provides a display device having the above-mentioned circuit.

In one aspect of the present invention, the gamma-reference-voltage generating circuit includes a first resistor string, a second resistor string, a first thermal compensation section and a second thermal compensation. The first resistor string includes a plurality of resistors for outputting a plurality of first polarity gamma-reference-voltages. The second resistor string includes a plurality of resistors for outputting a plurality of second polarity gamma-reference-voltages. The first thermal compensation section exhibits a resistance value that increases as a function of an increase of temperature. The first thermal compensation section includes a first end electrically connected to a first terminal for providing a first source of voltage and a second end electrically connected to the first resistor string. The second thermal compensation section exhibits a resistance value that decreases as a function of an increase of temperature. The second thermal compensation section includes a first end electrically connected to a second terminal for providing a second source of voltage having a magnitude which is less than the magnitude of the first source of voltage, and a second end electrically connected to the second resistor string.

In another aspect of the present invention, the apparatus for generating gamma-voltages includes a gamma-reference-voltage generating circuit and a gamma-voltage outputting section. The gamma-reference-voltage generating circuit comprises first and second resistor strings outputting a plurality of gamma-reference-voltages and a first thermal compensation section having a resistance value that varies as a function of temperature. The first thermal compensation section is electrically connected to a first voltage terminal receiving a first voltage to the first resistor string. The gamma-voltage outputting section has values in a first range coupled to the gamma-reference-voltage circuit. The gamma-voltage outputting section outputs a plurality of gamma-voltages in response to receipt of a plurality of the gamma-reference-voltages from the gamma-reference-voltage generating circuit.

In still another aspect of the present invention, the display device includes a display panel, a data driver, a gate driver and a gamma-reference-voltage generating section. The timing control section receives a first image signal and a first synchronization signal, and outputs a second image signal, a second synchronization signal and a third synchronization signal based on the first image signal and the first synchronization signal. The data driver outputs a data signal to the display panel based on the second image signal and the second synchronization signal. The gate driver outputs a gate signal to the display panel based on the third synchronization signal. The gamma-reference-voltage generating section generates a plurality of gamma-voltages, and provides the data driver with the gamma-voltages. The gamma-reference-voltage generating section includes a resistor string and a thermal compensation section. The resistor string outputs a plurality of gamma-reference-voltages.

The thermal compensation section has a resistance value that varies with temperature. The thermal compensation section is electrically connected to a source voltage terminal to which a source voltage is provided and the resistor that outputs gamma-reference-voltage corresponding to a high gradation.

According to the gamma-reference-voltage generating circuit, and the apparatus for generating gamma-voltages and the display device having the circuit, as the temperature increases, gamma-reference-voltages corresponding to white gradation are decreased and gamma-reference-voltages corresponding to black gradation are maintained, so that a deviation of kickback voltage corresponding to the white gradation relatively decreased.

Therefore, display quality is improved.

BRIEF DESCRIPTION OF THE DRAWINGS

The above and other advantages of the present invention will become readily apparent by reference to the following detailed description when considered in conjunction with the accompanying drawings wherein.

DETAILED DESCRIPTION OF THE EMBODIMENTS

Figure 1:
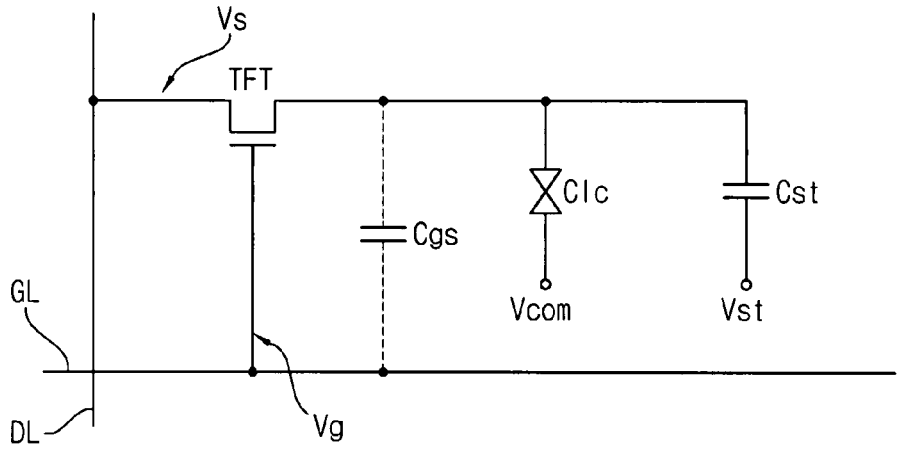
FIG. 1 is an equivalent circuit diagram showing a unit pixel of a liquid crystal display ("LCD") device of the type to which the present invention is applicable.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. In the drawings, the size and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the invention are described herein with reference to cross-section illustrations that are schematic illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the present invention will be explained in detail with reference to the accompanying drawings.

A pixel section of an LCD device includes a pixel that is formed on an area defined by two adjacent gate lines and two adjacent data lines that cross the gate lines.

FIG. 1 is an equivalent circuit diagram showing a pixel unit of a liquid crystal display (LCD) device of the type to which the present invention is applicable.

Referring to FIG. 1, a unit pixel of a conventional LCD device includes a thin-film transistor TFT, a liquid crystal capacitor Clc and a storage capacitor Cst. The thin-film transistor TFT includes a gate electrically connected to a gate line GL, and receives a gate voltage Vg through the gate line GL. A first end portion of the liquid crystal capacitor Clc and a first end portion of the storage capacitor Cst are electrically connected to a drain of the thin-film transistor TFT. The storage capacitor Cst is electrically connected to the liquid crystal capacitor Clc in order to keep the data voltage charged in the liquid crystal capacitor Clc until the next data voltage is charged therein.

The thin-film transistor TFT includes a drain electrically connected to a data line DL, and receives a data voltage Vs through the data line DL. When the gate voltage Vg is a turn-on level, the thin-film transistor TFT is turned-on, thereby charging the data voltage Vs in the liquid crystal capacitor Clc and the storage capacitor Cst, so that image information is displayed.

A common voltage Vcom is applied to a second end portion of the liquid crystal capacitor Clc. Therefore, a potential difference between the data voltage Vs and the common voltage Vcom is applied to the liquid crystal capacitor Clc, and a transmittance of light through the liquid crystal is changed by the potential difference, so that image information is displayed.

A liquid crystal corresponding to the liquid crystal capacitor Clc is deteriorated due to its own property when a voltage having the same polarity is continuously applied thereto, so that a positive polarity voltage and a negative polarity voltage should be alternately applied to drive the liquid crystal. The positive polarity voltage is substantially greater than the common voltage Vcom, and the negative polarity voltage is substantially lower than the common voltage Vcom.

In an ideal case, the magnitude of a potential difference between the data voltage Vs and the common voltage Vcom during the positive polarity voltage applied is the same as that of a potential difference between the data voltage Vs and the common voltage Vcom during the negative polarity voltage applied. However, a charging voltage of the liquid crystal capacitor Clc is reduced by a kickback voltage resulting from a parastic capacitor Cgs of the thin-film transistor TFT and so on, so that a magnitude of a charging voltage during the positive polarity voltage applied is different from that of a charging voltage during the negative polarity voltage applied.

Figure 2A:
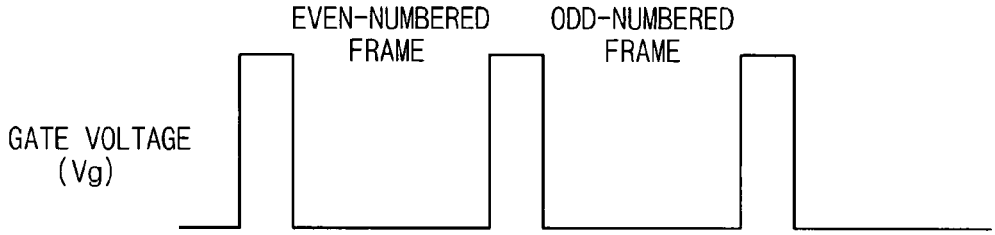
FIG. 2A is a waveform diagram illustrating a gate voltage that is applied to a gate line.
Figure 2B:
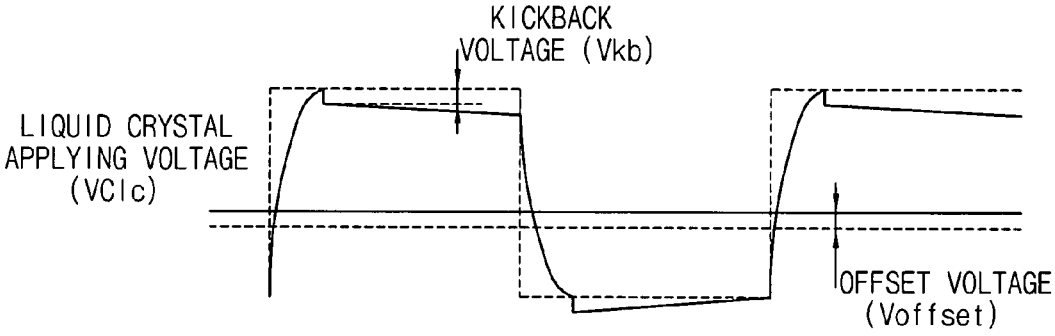
FIG. 2B is a waveform diagram illustrating a data voltage that is applied to a data line and a voltage that is applied to the liquid crystal capacitor.

FIG. 2A is a waveform diagram illustrating a gate voltage that is applied to a gate line. FIG. 2B is a waveform diagram illustrating a data voltage that is applied to a data line and a voltage that is applied to the liquid crystal capacitor.

In the waveform diagram of FIG. 2B, the dashed line shows a data voltage that is applied to the data line DL, and the continuous line shows a charging voltage in the liquid crystal capacitor Clc.

Referring to FIGS. 1 to 2B, when the gate voltage Vg is reduced from a turn-on level to a turn-off level, a maintained voltage of the liquid crystal capacitor Clc may be reduced by the kickback voltage Vkb.

Thus, a voltage difference corresponding to offset voltage Voffset appears between a common voltage Vcom and an average voltage of the positive polarity voltage and the negative polarity voltage. It is therefore desirable to compensate for the offset voltage Voffset. However, it is impossible to perfectly compensate for the offset voltage Voffset, so that a blinking phenomenon called a flicker is produced.

Additionally, a residual image of the LCD device results when the LCD device is used for a long time. The occurrence of the residual image may be explained by ionic impurities of a liquid crystal layer and a DC voltage that is applied to the liquid crystal layer for a long time. For example, the DC voltage effect may be occurred in accordance with a temperature.

Generally, a driving condition of the LCD device is set at room temperature, for example, about 25° C. However, the LCD device is used in a condition that various chassis or cases are coupled to the LCD device. For example, when the LCD device is applied to a television ("TV") set, the temperature of the LCD device increases to about 10° C. to about 15° C.

Therefore, a reliability test for the residual image is performed in a chamber of about 50° C. When a temperature of the LCD device is increased, a permittivity of a liquid crystal of the LCD device is varied. As the permittivity of a liquid crystal is varied, a variation of a kickback voltage Vk is occurred as described in the following Equation 1.

$$Vk = \frac{Cgs}{Clc + Cst + Cgs}\Delta Vg \qquad \text{Equation 1}$$

Wherein, 'Vk' represents a kickback voltage, 'Clc' represents a liquid crystal capacitance of a liquid crystal capacitor, 'Cst' represents a storage capacitance of a storage capacitor, 'Cgs' represents a parasitic capacitance between a gate electrode and a source electrode, and 'ΔVg' represents a voltage difference between a gate on voltage Von and a gate-off voltage Voff. Also, the liquid crystal capacitance Clc is defined by ∈A/d, wherein '∈' represents permittivity of a liquid crystal, 'A' represents a size of a pixel electrode, and 'd' represents a cell gap of a liquid crystal layer.

Figure 3A:
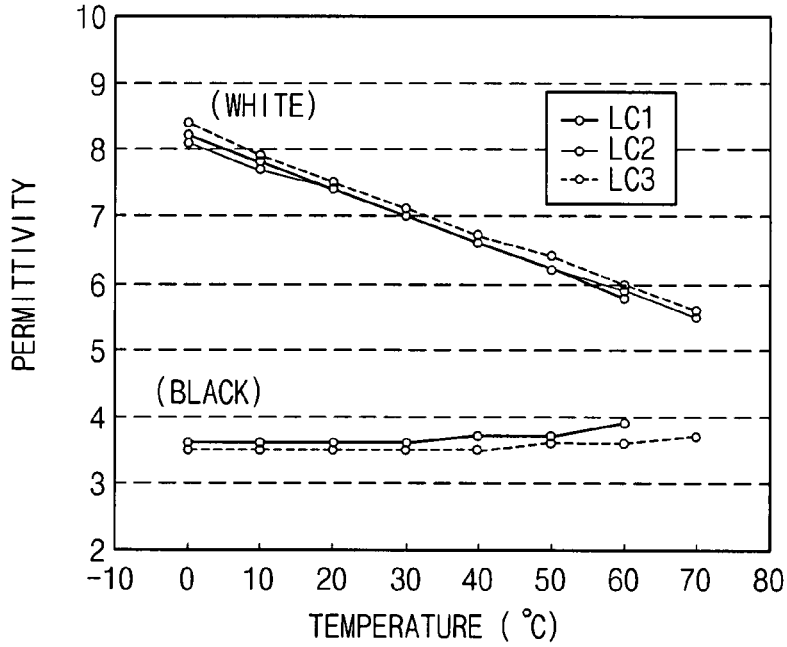
FIGS. 3A and 3B are graphs showing a variation of permittivity of the liquid crystal according as a function of temperature.
Figure 3B:
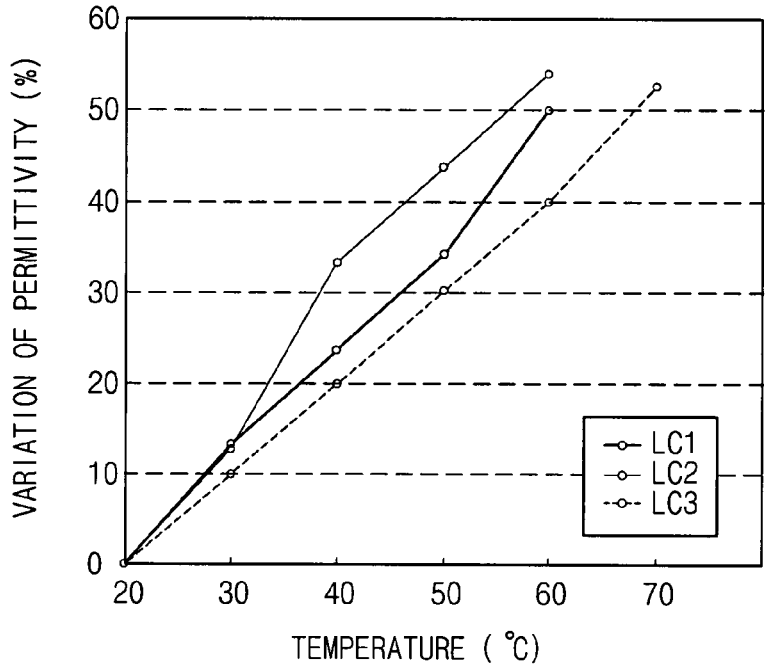

In particular, when a temperature of the liquid crystal varies from about 20° C. to about 50° C., the permittivity of a liquid crystal '∈' varies to more than about 30%, as shown in FIGS. 3A and 3B.

FIGS. 3A and 3B are graphs showing a variation of permittivity of the liquid crystal according to temperature. Particularly, FIG. 3A shows a permittivity curve of a liquid crystal according to temperature, FIG. 3B shows a variation curve of permittivity of the liquid crystal according to temperature. In FIGS. 3A and 3B, LC1, LC2 and LC3 donate different liquid crystals from each other.

Referring to FIGS. 3A and 3B, a ratio of a permittivity of the liquid crystal is reflected to a ratio of variation of liquid crystal capacitance. Generally, the capacitance of liquid crystal capacitor Clc is substantially equal to the capacitance of storage capacitor Cst, and a parasistic capacitance between gate electrode and source electrode Cgs is relatively small so that the parasitic capacitance is ignored. Therefore, when the liquid crystal capacitance Clc is increased, the kickback voltage is decreased.

When a full-voltage is applied to a liquid crystal layer in order to realize a white pattern, a permittivity of a liquid crystal is decreased according to the increase of temperature.

For example, in FIG. 3A, when a temperature of the liquid crystal is about 0° C., a permittivity of a liquid crystal is about 8 to about 8.5, however when a temperature of the liquid crystal is about 60° C., a permittivity of a liquid crystal is about 6.

Alternatively, when voltage is not applied to a liquid crystal layer in order to realize the black pattern, a variation of a liquid crystal permittivity does not substantially exist according to the increase of temperature. For example, in FIG. 3A, when the temperature of the liquid crystal is about 0° C., a liquid crystal permittivity is about 3.5, however when a temperature of the liquid crystal is about 60° C., a liquid crystal permittivity is about 3.7.

Figure 4:
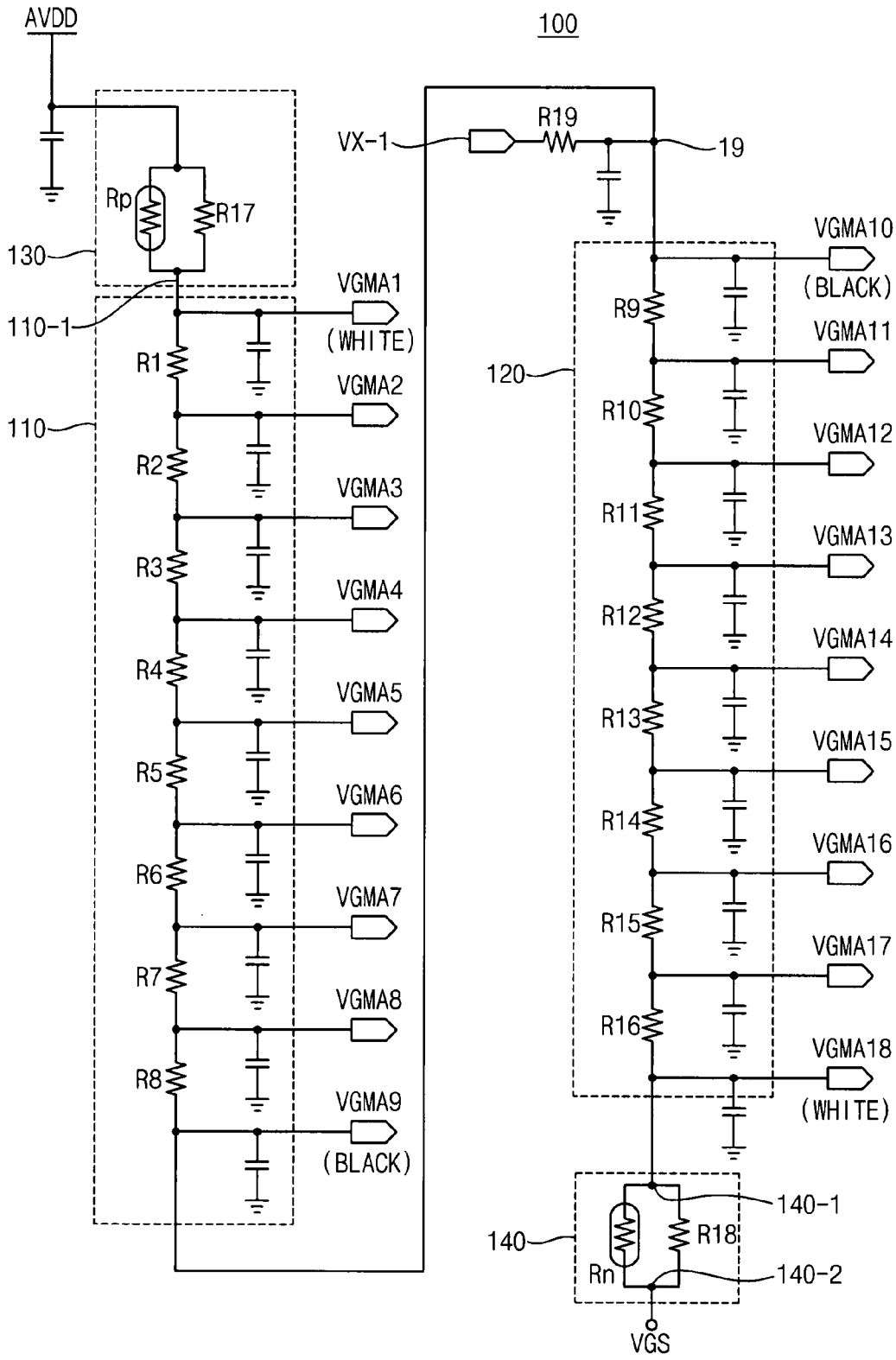
FIG. 4 is a circuit diagram illustrating a gamma-reference-voltage generating circuit according to one embodiment of the present invention.

FIG. 4 is a circuit diagram illustrating a gamma-reference-voltage generating circuit according to one exemplary embodiment of the present invention.

Referring to FIG. 4, a gamma-reference-voltage generating circuit 100 includes a first resistor string 110, a second resistor string 120, a first thermal compensation section 130 and a second thermal compensation section 140, and a plurality of outputs which provides a plurality of gamma-reference-voltages.

The first resistor string 110 is electrically connected between output terminal 110-1 of the first thermal compensation section 130 and terminal Vx-1 to which a third source voltage Vx is applicable. The first resistor string 110 divides the first source voltage AVDD through the first thermal compensation section 130 and the third source voltage Vx, and outputs a plurality of first polarity gamma-reference-voltages. For example, the first resistor string 110 may include first resistor R1, second resistor R2, third resistor R3, fourth resistor R4, fifth resistor R5, sixth resistor R6, seventh resistor R7 and eighth resistor R8. Therefore, the first resistor string 110 outputs first to ninth gamma-reference-voltages VGMA1, VGMA2, VGMA3, VGMA4, VGMA5, VGMA6, VGMA7, VGMA8 and VGMA9 of the first polarity at the indicated associated terminals.

The second resistor string 120 is electrically connected between terminal 19 and input terminal 140-1 of third thermal compensation section 140. Second source voltage VGS is connected to terminal 140-2 of third thermal compensation section 140. The second resistor string 120 divides into the third source voltage Vx and a second source voltage VGS, and outputs a plurality of second polarity gamma-reference-voltages. For example, the second resistor string 120 may include a ninth resistor R9, a tenth resistor R10, an eleventh resistor R11, a twelfth resistor R12, a thirteenth resistor R13, a fourteenth resistor R14, a fifteenth resistor R15 and a sixteenth resistor R16. Therefore, the second resistor string 120 outputs the tenth to eighteen gamma-reference-voltages VGMA10, VGMA11, VGMA12, VGMA13, VGMA14, VGMA15, VGMA16, VGMA17 and VGMA18 having a second polarity.

The first thermal compensation section 130 is electrically connected to first voltage source AVDD, which may be for example about 5 volts to about 12 volts, and has a resistance value that increases as the ambient temperature increases. The first thermal compensation section 130 includes a positive thermistor Rp and the seventeenth resistor R17 that is connected in parallel with the positive thermistor Rp.

The second thermal compensation section 140 is electrically connected to a second source voltage terminal to which a second source voltage VGS is applied, which may be for example about 0 volts, and has a resistance value that decreases as the temperature increases. The second thermal compensation section 140 includes a negative thermistor Rn and the eighteenth resistor R18 that is connected in parallel with the negative thermistor Rn.

In FIG. 4, thermistors are used to achieve temperature compensation. The resistance value of negative thermistor Rn decreases as the ambient temperature increases. Particularly, a variation of kickback voltage of the white gradation side is substantially higher than other gradation sides of the PVA mode LCD device. Therefore, the positive thermistor Rp is electrically connected to a terminal to which first source voltage AVDD is applied. AVDD is higher than VGS which is applied to second thermal compensation section 140.

That is, the more a temperature is increased in a white condition, the more a kickback voltage is increased, so that a gamma-reference-voltages should be decreased, which is corresponded to the white gradation applied from an external device.

To decrease the gamma-reference-voltages, the positive thermistor Rp is connected to first voltage source AVDD having a relatively high voltage, and the negative thermistor Rn is connected to second voltage source VGS having a relatively low voltage. The positive thermistor Rp has an increasing resistance as temperature increases. The negative thermistor Rn has a decreasing resistance as temperature increases.

Hereinafter, a negative thermistor Rn that is disposed at a second source voltage VGS is explained in detail.

When ambient temperature increases, the resistance of the negative thermistor Rn decreases. Thus, the tenth to eighteenth gamma-reference-voltages VGMA10~VGMA18 are decreased. Particularly, a decreased interval of the eighteenth VGMA18 is the biggest, which is corresponded to a white degradation, and decreased intervals become smaller as going to the tenth gamma-reference-voltage.

Assuming that the third source voltage Vx is about 10V and the ninth to sixteenth resistors R9~R16 each are about 10Ω. Also, assume that the negative thermistor Rn has a resistance of about 20Ω in a thermal condition of about 25° C. and a resistance of about 10Ω in a thermal condition of about 50°.

As a thermal condition has varied from about 20° C. to about 50° C., the decreased interval of the eighteenth gamma-reference-voltage VGMA18 is defined by the following Equation 2.

$$\Delta Vgamma(18) = 10\left(\frac{20}{110} - \frac{10}{100}\right) = 0.81\ \text{V} \qquad \text{Equation 2}$$

Alternatively, as a thermal condition has varied from about 25° C. to about 50° C., the decreased interval of the tenth gamma-reference-voltage VGMA10 is defined by the following Equation 3.

$$\Delta Vgamma(10) = 10\left(\frac{100}{110} - \frac{90}{100}\right) = 0.09\ \text{V} \qquad \text{Equation 3}$$

Therefore, as the thermal condition has varied from about 25° C. to about 50° C., the decreased interval of the eighteenth gamma-reference-voltage VGMA18 is 9 times of the decreased interval of the tenth gamma-reference-voltage VGMA10.

The tenth gamma-reference-voltage VGMA10 is also decreased as shown in the above Equation 3. In case of a black gradation, the permittivity of a liquid crystal is increased, as shown in FIGS. 3A and 3B.

The first and second thermal compensation sections 130 and 140 including a resistor that is parallely connected to the thermistor is described in FIG. 4. Alternatively, the first and second thermal compensation sections 130 and 140 may include a thermistor, a resistor that is parallely connected to the thermistor and a resistor that is serially connected to the thermistor.

When the thermistor is singlely used, a difference between a variation ratio of a negative thermal coefficient of the thermistor and a desirable coefficient of the thermistor may be occurred.

Accordingly, the thermistor and a resistor that is parallely connected to the thermistor are, for another example, disposed in the gamma-reference-voltage generating circuit 100 (as shown in FIG. 4).

In order to decrease a difference of the negative thermal coefficients, a thermistor, a resistor that is parallely connected to the thermistor and a resistor that is serially connected to the thermistor are, for another example, disposed in the gamma-reference-voltage generating circuit 100.

As described above, the thermistor (positive thermistor) is disposed between the voltage input terminal and the first resistor string that is disposed in the gamma-reference-voltages generating circuit. The voltage input terminal has a relatively high level. The first resistor string outputs gamma-reference-voltages have a relatively higher level than a common voltage. As a temperature is increased, a resistance of the positive thermistor is increased.

Additionally, the thermistor (negative thermistor) is disposed between the voltage input terminal and the second resistor string that is disposed in the gamma-reference-voltages generating circuit. The voltage input terminal has a relatively lower level than the first voltage source AVDD. The second resistor string outputs gamma-reference-voltages having a relatively lower level than a common voltage. As a temperature is increased, a resistance of the negative thermistor is decreased.

Therefore, in proportion to an increasing of the temperature, the gamma-reference-voltage corresponding to a white gradation is relatively decreased, and the gamma-reference-voltages corresponding to a black gradation is maintained. Thus, a deviation of the kickback voltage of the white gradation is decreased although the temperature is increased, so that display characteristics of the LCD device are prevented from being deteriorated.

Figure 5:
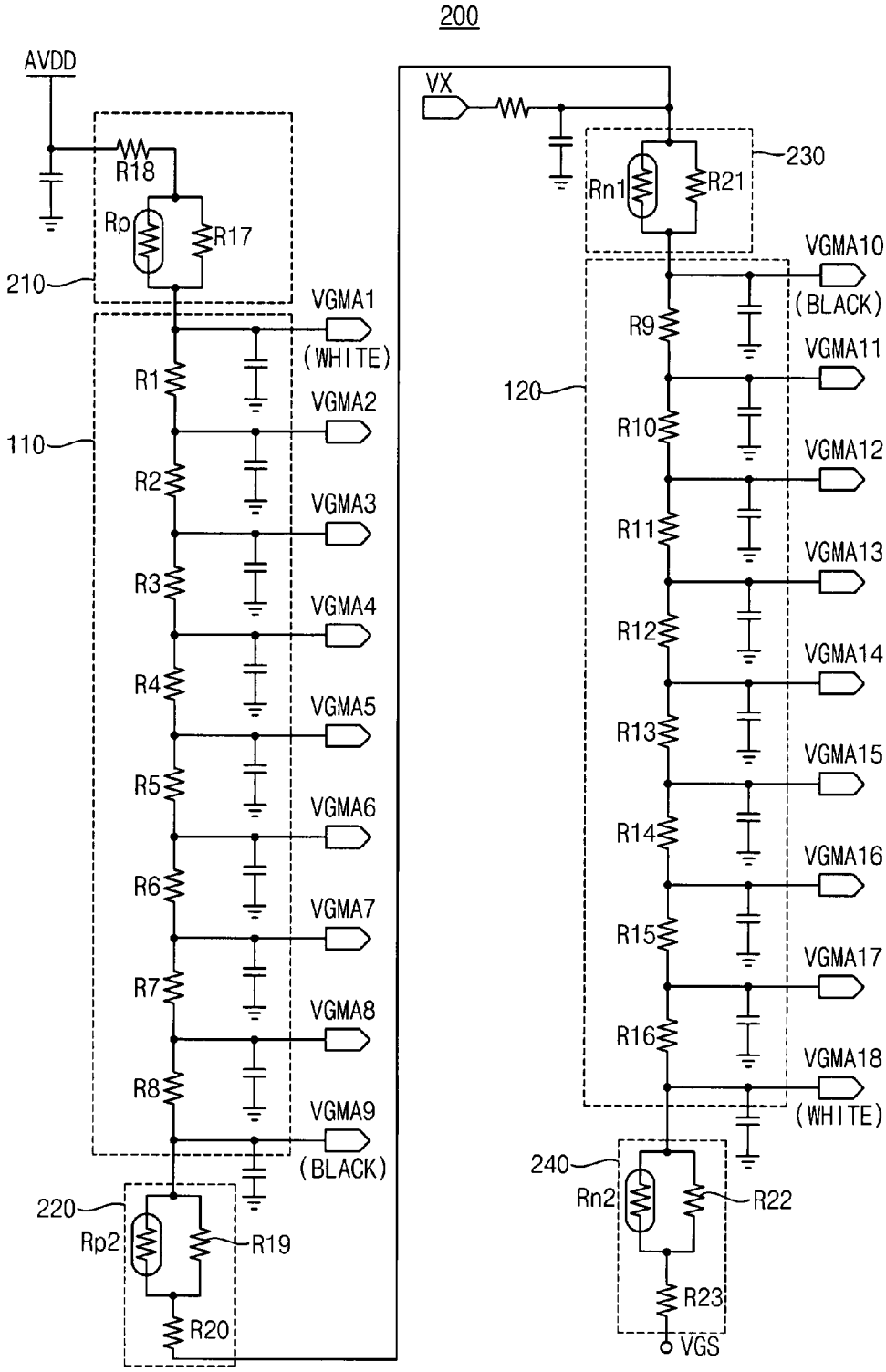
FIG. 5 is a circuit diagram illustrating a gamma-reference-voltage generating circuit according to another embodiment of the present invention.

FIG. 5 is a circuit diagram illustrating a gamma-reference-voltage generating circuit according to another exemplary embodiment of the present invention.

Referring to FIG. 5, the gamma-reference-voltage generating circuit 200 includes a first resistance string 110, a second resistance string 120, a first main-thermal compensation section 210, a first sub-thermal compensation section 220, a second sub-thermal compensation section 230 and a second main-thermal compensation section 240. Referring now in specific detail to FIG. 4 in which like reference numerals identify identical elements, detailed descriptions about the identical elements will be omitted.

The first main-thermal compensation section 210 includes a first end portion electrically connected to a first source voltage AVDD and a second end portion electrically connected to the first resistance string 110. The first main-thermal compensation section 210 has an increasing resistance value according to the increase of temperature. The first main-thermal compensation section 210 includes a positive thermistor Rp1, a seventeenth resistor R17 parallelly connected to the positive thermistor Rp1 and an eighteenth resistor R18 serially connected to the seventeenth resistor R17. The eighteenth resistor R18 is electrically connected to the first source voltage AVDD.

The first main-thermal compensation section 210 is disposed between the first resistor string 110 and the first source voltage AVDD, and has an increasing resistance value according to the increase of temperature. The first sub-thermal compensation section 220 includes a positive thermistor Rp2, a nineteenth resistor R19 parallelly connected to the positive thermistor Rp2 and a twentieth resistor R20 serially connected to the nineteenth resistor R19. The twentieth resistor R20 is electrically connected to the third source voltage Vx.

The second sub-thermal compensation section 230 is disposed between the second resistor string 120 and the third source voltage Vx, and has a decreasing resistance value according to the increase of temperature. The second sub-thermal compensation section 230 includes a negative thermistor Rn1, a twentieth-first resistor R21 parallelly connected to the negative thermistor Rn1. The twentieth-first resistor R21 is electrically connected to the third source voltage Vx.

The second main-thermal compensation section 240 includes a first end portion electrically connected to a second source voltage VGS that is lower than the first source voltage AVDD and a second end portion electrically connected to the second resistance string 120. The second main-thermal compensation section 240 has a decreasing resistance value according to the increase of temperature. The second main-thermal compensation section 240 includes a negative thermistor Rn2, a twentieth-second resistor R22 parallelly connected to the negative thermistor Rn2 and a twentieth-third resistor R23 serially connected to the twentieth-second resistor R22. The twentieth-third resistor R23 is electrically connected to the second source voltage VGS, for example, a ground voltage.

Figure 6:
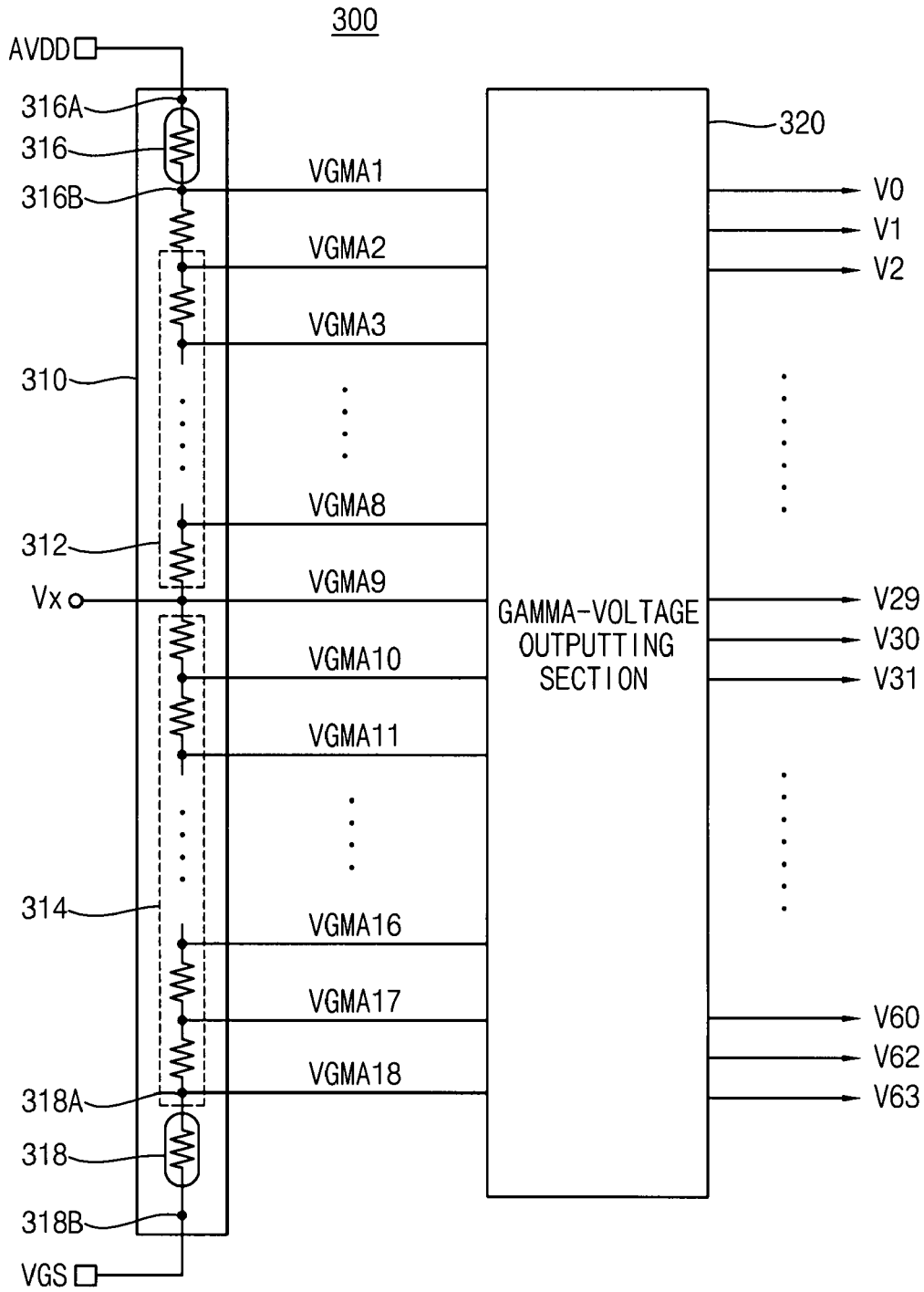
FIG. 6 is a combination circuit and block diagram illustrating a gamma-voltage generating section according to still another exemplary embodiment of the present invention.

FIG. 6 is a block diagram illustrating a gamma-voltage generating section according to still another exemplary embodiment of the present invention.

Referring to FIG. 6, gamma-voltage generating section 300 according to still another exemplary embodiment of the present invention includes a gamma-reference-voltage generating section 310 and a gamma-voltage outputting section 320.

The gamma-reference-voltage generating section 310 includes a first resistor string 312, a second resistor string 314, a first main-thermal compensation section 316 and a second main-thermal compensation section 318.

The first resistor string 312 provides the gamma-voltage outputting section 320 with a plurality of first polarity gamma-reference-voltages VGMA1~VGMA9. When the first resistor string 312 includes eight resistors that are serially connected, the first polarity gamma-reference-voltages include first to ninth gamma-reference-voltages VGMA1~VGMA9.

The second resistor string 314 provides the gamma-voltage outputting section 320 with a plurality of second polarity gamma-reference-voltages VGMA10~VGMA18. When the second resistor 314 includes eight resistors that are serially connected, the second polarity gamma-reference-voltages include tenth to eighteenth gamma-reference-voltages VGMA10~VGMA18.

The first main-thermal compensation section 316 includes a first terminal 316A and a second end terminal 316B, and exhibits an increasing resistance value in proportion to an increase of temperature. The first terminal 316A is electrically connected to a first source voltage AVDD. The second portion 316B is electrically connected to the first resistor string 312.

The second main-thermal compensation section 318 includes a first portion terminal 318A and a second portion terminal 318B, and exhibits a decreasing resistance value in proportion to an increase of temperature. The first terminal 318B is electrically connected to a second voltage source VGS that is lower than the first source voltage AVDD. The second terminal 318A is electrically connected to the second resistor string 314.

The first and second resistor string 312 and 314 are commonly connected to each other, and are provided from a third voltage source Vx.

In operation, the first main-thermal compensation section 316 provides the first resistor string 312 with a first source voltage AVDD that is gradually decreased using a gradually increasing resistance value with the increasing temperature. Therefore, the first resistor string 312 divides the decreased first source voltage AVDD due to an increase of temperature and the third source voltage Vx into the first to ninth gamma-reference-voltages VGMA1~VGMA9, and provides the gamma-reference-voltage outputting section 320 with the first to ninth gamma-reference-voltages VGMA1~VGMA9.

Additionally, the second main-thermal compensation section 318 provides the second resistor string 314 with a source voltage gradually near to the second source voltage VGS using a gradually decreasing resistance value with the increasing temperature. Therefore, the second resistor string 314 divides the third source voltage Vx and the decreased second source voltage VGS due to the increasing temperature into the tenth to eighteenth gamma-reference-voltages VGMA10~VGMA18, and provides the gamma-reference-voltage outputting section 320 with the tenth to eighteenth gamma-reference-voltages VGMA10~VGMA18.

The gamma-voltage outputting section 320 outputs a plurality of gamma-voltages V0, V1, V2, . . . , V62 and V63 using the first to eighteenth gamma-reference-voltages VGMA1~VGMA18 provided from the gamma-reference-voltage generating section 310. The circuitry and operation of a gamma-voltage outputting section of the type which may be used to implement gamma-voltage outputting section 320 is well known to those skilled in the art and accordingly is only briefly described below.

For example, the gamma-voltage outputting section 320 may include third to tenth resistor strings. A first gamma-reference-voltage VGMA1 is applied to a first end portion of the third resistor string, and a second gamma-reference-voltage VGMA2 is applied to a second portion thereof. Therefore, the third resistor string divides the first and second gamma-reference-voltages VGMA1 and VGMA2 into first to eighth gamma-voltages V0~V7, and outputs the first to eighth gamma-voltages V0~V7.

Additionally, a second gamma-reference-voltage VGMA2 is applied to a first end portion of the fourth resistor string, and a third gamma-reference-voltage VGMA3 is applied to a second portion thereof Therefore, the fourth resistor string divides the second and third gamma-reference-voltages VGMA2 and VGMA3 into ninth to sixteenth gamma-voltages V8~V15, and outputs the ninth to sixteenth gamma-voltages V8~V15.

Furthermore, an eighteenth gamma-reference-voltage VGMA18 is applied to a first end portion of the tenth resistor string, and the second source voltage VGS is applied to a second portion thereof. Therefore, the tenth resistor string divides the nineteenth and the second source voltage VGS into fifty-sixth to sixty-fourth gamma-voltages V54~V63, and outputs the fifty-sixth to sixty-fourth gamma-voltages V54~V63.

Figure 7:
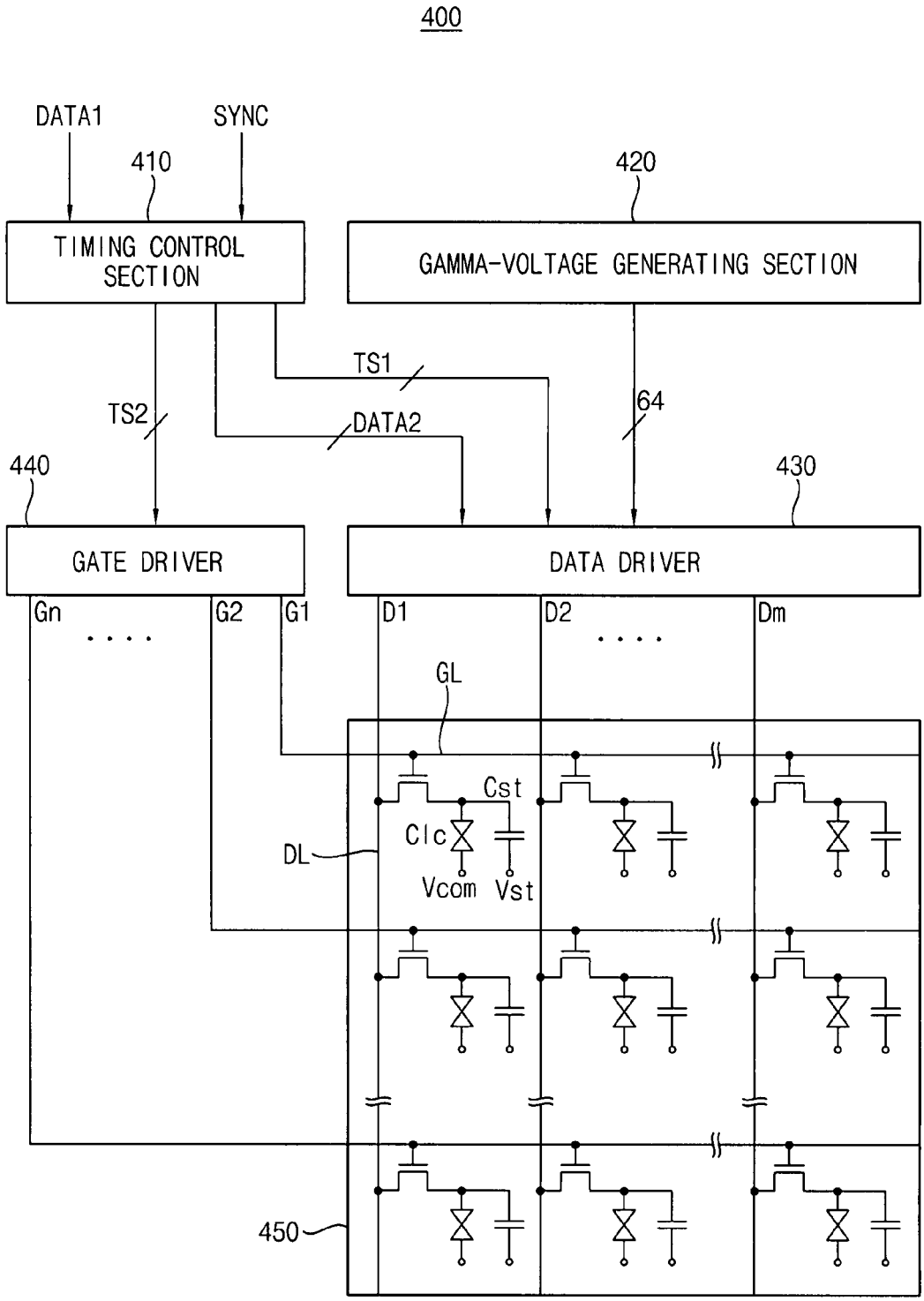
FIG. 7 is a block diagram illustrating a LCD device according to still another exemplary embodiment of the present invention.

FIG. 7 is a block diagram illustrating an LCD device according to still another exemplary embodiment of the present invention.

Referring to FIG. 7, an LCD device 400 according to still another exemplary embodiment of the present invention includes a timing control section 410, a gamma-voltage generating section 420, a data driver 430, a gate driver 440 and an LCD panel 450.

The timing control section 410 receives a first data signal DATA1 and a synchronizing signal SYNC from an external host system such as a graphic controller. The synchronizing signal SYNC may include a vertical synchronizing signal (Vsync), a horizontal synchronizing signal (Hsync), a main clock signal (MCLK), and a data enable signal (DE). The vertical synchronizing signal (Vsync) represents a time required for displaying one frame. The horizontal synchronizing signal (Hsync) represents a time required for displaying one line of the frame. Thus, the horizontal synchronizing signal includes pulses corresponding to the number of pixels included in one line. The data enable signal (DE) represents a time required for supplying the pixel with data.

The timing control section 410 outputs a second data signal DATA2 and a first control signal TS1 to the data driver 430, and outputs a second control signal TS2 to the gate driver 440. The first control signal TS1 may include a load signal, a horizontal start signal and a polarity control signal for outputting the second data signal DATA2. The second control signal TS2 may include a gate clock signal (GCLK) and a vertical start signal (STV).

Figure 8:
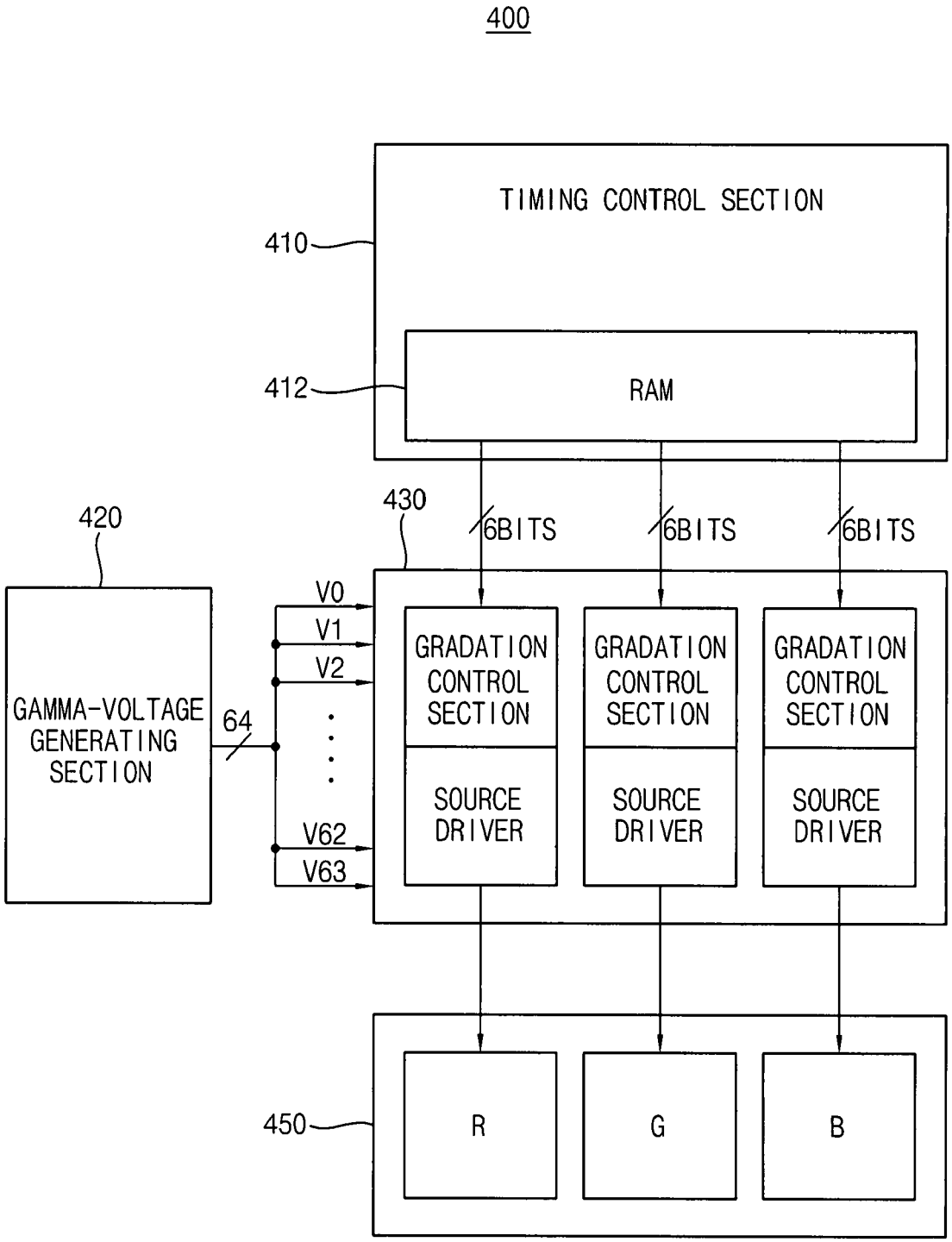
FIG. 8 is a block diagram illustrating an operation of the LCD device in FIG. 7.

The gamma-voltage generating section 420, which may be implemented with circuit 300 as shown in FIG.6, generates a plurality of gamma-voltages, and provides the data driver 430 with the gamma-voltages. In FIG. 8, the gamma-voltage generating section 420 outputs 64 gamma-voltages V0, V1, . . . , V62 and V63.

The data driver 430 provides the LCD panel 450 with a plurality of data voltages based on the second data signal DATA2, the first control signal TS1 and the gamma-voltages V0, V1, . . . , V62 and V63.

For example, the data driver 430 may include a printed circuit board (PCB), a flexible PCB (FPCB) electrically connected to the PCB, and one or a plurality of data driving chips that are mounted on the FPCB. For another example, the data driver 430 may have been mounted on a peripheral area of the LCD panel 450.

The gate driver 440 sequentially provides the LCD panel 450 with a plurality of gate voltages. The gate driver 440 includes, for example, a PCB, a FPCB electrically connected to the PCB, and one or plural gate driving chips that are mounted on the FPCB.

In another embodiment, the gate driver 440 includes a FPCB and one or a plurality gate driving chips that are mounted on the FPCB. In a further embodiment, the gate driver 440 may be mounted on a peripheral area of the LCD panel 450.

The LCD panel 450 includes a plurality of gate lines, a plurality data lines, a thin-film transistor TFT formed on an area surrounded by adjacent gate lines and adjacent data lines, a liquid crystal capacitor Clc electrically connected to the TFT and a storage capacitor Cst electrically connected to the TFT.

In operation, the gate line GL transfers the gate voltage to the TFT. The data line DL transfers the data voltage to the TFT. The liquid crystal capacitor Clc is turned-on/off based on the gate voltage, thereby charging the data voltage. The storage capacitor Cst stores the data voltage via the turned-on TFT, and provides the liquid crystal capacitor Clc with the charged data voltage during a turned-off time interval of the TFT.

FIG. 8 is a block diagram illustrating an operation of the LCD device in FIG. 7.

Referring to FIG. 7 and FIG. 8, a graphic RAM 412 of the timing control section 410 provides the data driver 430 with 6-bit R image data, 6-bit G image data and 6-bit B image data.

The gamma-voltage generating section 530 provides the data driver 430 with a 64 gamma-voltages V0, V1, . . . , V62 and V63.

The data driver 430 includes a plurality of 64-gradation of controllers and a plurality of source drivers to transform RGB image data into RGB image signals. The data driver 430 transforms the RGB image data into the RGB image signals based on the 64-numbers of gamma-voltages V0, V1, . . . , V62 and V63, and provides the RGB pixel disposed in the LCD panel 450 with the transformed RGB image signals.

As shown in FIG. 8, the number of gamma-voltages is 64, RGB image data are 6 bits, respectively, so that 262,144(64×64×64) colors may be totally displayed through the LCD panel 450.

In this exemplary embodiment, the LCD device performs a display operation using a gamma-voltage that is generated through a resistance division method. Alternatively, it will be apparent to people of ordinary skill in the art that the LCD device performs a display operation using a gamma-voltage that is extracted from a digital gamma IC. The digital gamma IC stores a plurality of gamma tables corresponding to predetermined temperature ranges.

Figure 9:
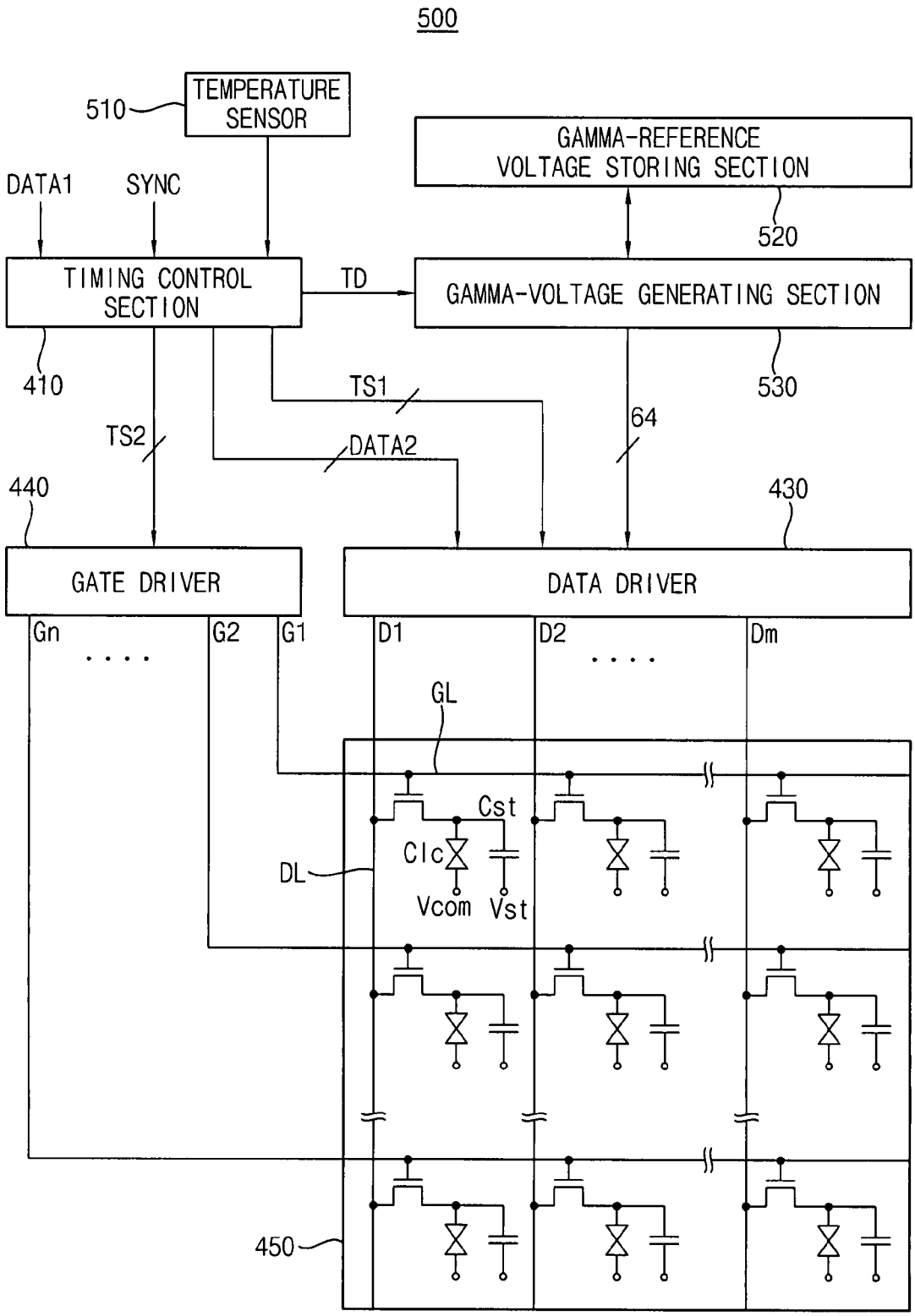
FIG. 9 is a block diagram illustrating a LCD device according to another exemplary embodiment of the present invention.
Figure 10:
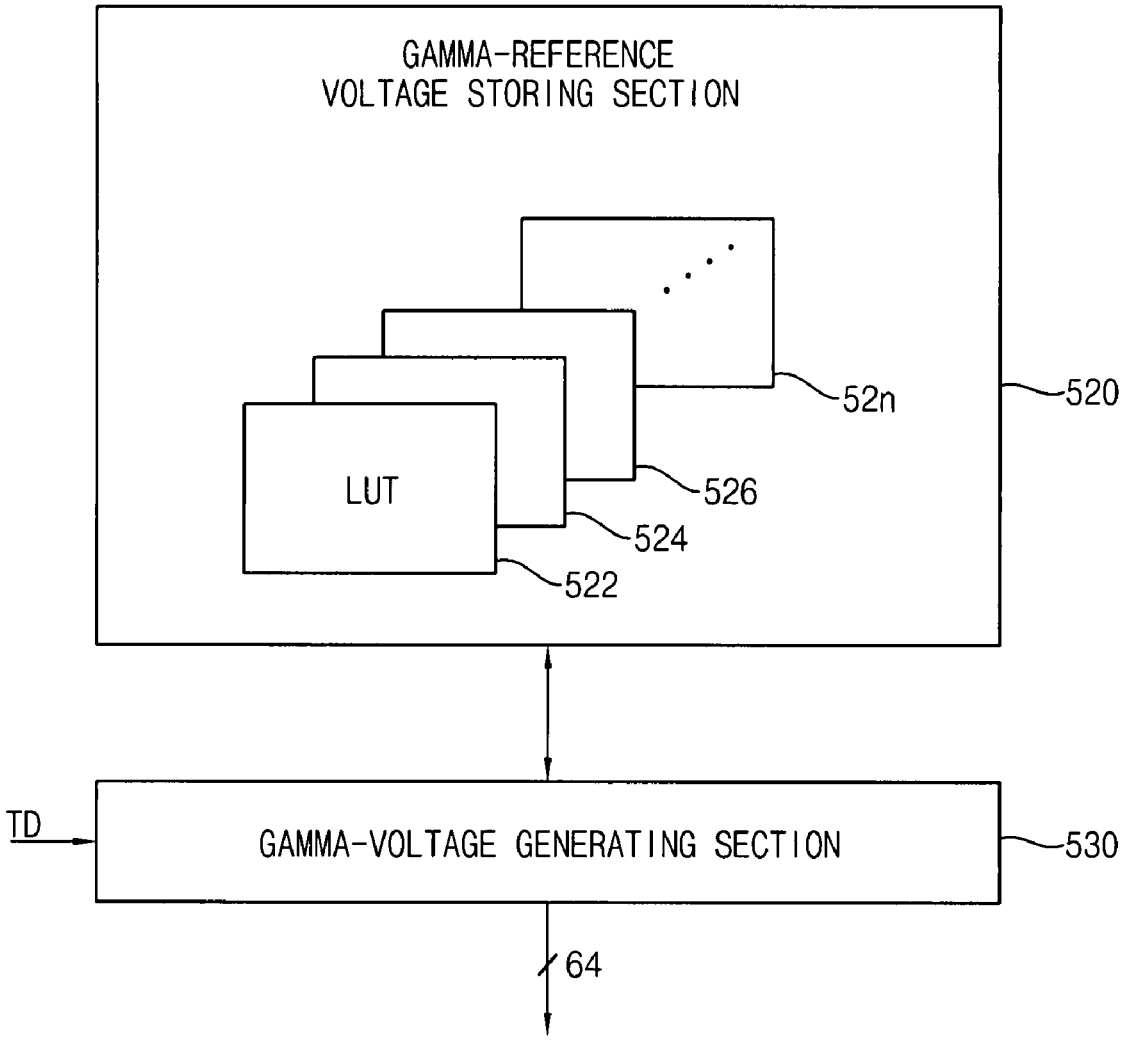
FIG. 10 is a block diagram illustrating a gamma-reference-voltage storing section in FIG. 9.

FIG. 9 is a block diagram illustrating an LCD device according to still another exemplary embodiment of the present invention. FIG. 10 is a block diagram illustrating in more detail gamma-reference-voltage storing section 520 shown in FIG. 9.

Referring to FIGS. 9 and 10, a LCD device according to still another exemplary embodiment of the present invention includes a temperature sensor 510, a timing control section 410, a gamma-reference-voltage storing section 520, a gamma-voltage generating section 530, a data driver 430, a gate driver 440 and an LCD panel 450. Referring now in more specific detail to FIGS. 9 and 10, in which like reference numerals identify identical elements, detailed descriptions about the identical elements is omitted.

The temperature sensor 510 senses a temperature of the LCD device, and provides the timing controlling section 410 with the sensed temperature data.

The gamma-reference-voltage storing section 520 includes a plurality of look up tables 522, 524, 526, . . . , 52*n* which store gamma-reference-voltages for a range of temperatures. For example, the look up tables 522, 524, 526, . . . , 52*n* may include a first look up table 522 which stores voltages for a temperature interval of about 21° C. to about 30° C., a second look up table 524 which stores voltages for a temperature interval of about 31° C. to about 40° C., and a third look up table corresponding to a temperature interval of about 41° C. to about 50° C. Each of the look up tables stores a plurality of gamma-reference-voltages. The gamma-reference-voltage is set by using a varied resistance in accordance with temperature.

The gamma-voltage generating section 530 receives a temperature data TD from timing control section 410, and extracts a look up table corresponding to the temperature data TD from the gamma-voltage storing section 520. The gamma-voltage generating section 530 outputs a plurality of gamma-voltages V0, V1, V2, . . . , V62, V63 based on the first to eighteenth gamma-reference-voltages VGMA1~VGMA18 from the gamma-voltage storing section 520 corresponding to the temperature interval of the temperature data TD.

For example, the gamma-voltage generating section 530 may include a first to eighth resistor strings. A first gamma-reference-voltage VGMA1 is applied to a first end portion of the first resistor string, and a second gamma-reference-voltage VGMA2 is applied to a second portion thereof. Therefore, the first resistor string divides the first and second gamma-reference-voltages VGMA1 and VGMA2 into first to eighth gamma-voltages V0~V7, and outputs the first to eighth gamma-voltages V0~V7.

Additionally, a second gamma-reference-voltage VGMA2 is applied to a first end portion of the second resistor string, and a third gamma-reference-voltage VGMA3 is applied to a second portion thereof. Therefore, the second resistor string divides the second and third gamma-reference-voltages VGMA2 and VGMA3 into ninth to sixteenth gamma-voltages V8~V15, and outputs the ninth to sixteenth gamma-voltages V8~V15.

As described above, the thermal compensation section is disposed between a voltage input terminal having a relatively high level and a first resistor string that outputs gamma-reference-voltages having a relatively higher level than a common voltage. The thermal compensation section has a resistance that increases in proportion to an increasing of temperature.

Additionally, the thermal compensation section is disposed between a voltage input terminal having a relatively low level and a second resistor string that outputs gamma-reference-voltages having a relatively lower level than a common voltage. The thermal compensation section has a resistance that decreases in proportion to an increasing of temperature.

Therefore, in proportion to an increase of temperature, the gamma-reference-voltage corresponding to a white gradation is relatively decreased, and the gamma-reference-voltages corresponding to a black gradation is maintained. Thus, a deviation of the kickback voltage of the white gradation is decreased although the temperature is increased, so that display characteristics of the LCD device are prevented from being deteriorated.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

What is claimed is:

1. A gamma-reference-voltage generating circuit comprising:

a first resistor string including a plurality of resistors for outputting a plurality of first polarity gamma-reference-voltages;

a second resistor string including a plurality of resistors for outputting a plurality of second polarity gamma-reference-voltages;

a first thermal compensation section exhibiting a resistance value that varies as a function of an increase of temperature, the first thermal compensation section including a first end electrically connected to a first terminal for providing a first source of voltage and a second end electrically connected to the first resistor string; and a second thermal compensation section exhibiting a resistance value that varies as a function of an increase of temperature, the second thermal compensation section including a first end electrically connected to a second terminal for providing a second source of voltage having a magnitude which is less than the magnitude of the first source of voltage, and a second end electrically connected to the second resistor string, wherein the resistors of the first resistor string are connected in series and the resistors of the second resistor string are connected in series, and the first and second resistor strings and the first and second thermal compensation sections are connected to each other in series.

2. The gamma-reference-voltage generating circuit of claim 1, wherein the first thermal compensation section comprises a positive thermistor having a resistance value that increases as a function of an increase of temperature.

3. The gamma-reference-voltage generating circuit of claim 1, wherein the first thermal compensation section comprises:

a positive thermistor; and a first resistor that is connected in parallel with the positive thermistor.

4. The gamma-reference-voltage generating circuit of claim 3, wherein the first thermal compensation section further comprises a second resistor which is serially connected in a path between the first resistor string and the first source of voltage.

5. The gamma-reference-voltage generating circuit of claim 1, wherein the second thermal compensation section comprises a negative thermistor having a resistance value that decreases as a function of an increase of temperature.

6. The gamma-reference-voltage generating circuit of claim 5, wherein the second thermal compensation section further comprises a first resistor that is connected in parallel with the negative thermistor.

7. The gamma-reference-voltage generating circuit of claim 6, wherein the second thermal compensation section comprises a second resistor which is serially connected in a path between the second source of electrical potential and the second resistor string.

8. The gamma-reference-voltage generating circuit of claim 1, further comprising a third voltage terminal for providing a third voltage to a common terminal between the first resistor string and the second resistor string.

9. The gamma-reference-voltage generating circuit of claim 8, further comprising a third thermal compensation section having a first terminal connected to an end of the first resistance string and a second terminal coupled to the third voltage terminal, wherein the third thermal compensation section exhibits a resistance having a magnitude which increases in response to an increase of temperature.

10. The gamma-reference-voltage generating circuit of claim 9, wherein the third thermal compensation section comprises a first positive thermistor.

11. The gamma-reference-voltage generating circuit of claim 9, wherein the third thermal compensation section comprises:

a first positive thermistor; and a first resistor connected in parallel with the first positive thermistor.

12. The gamma-reference-voltage generating circuit of claim 11, further comprising a second resistor coupled in series between a terminal common to the first resistor and the positive thermistor and an end of the second resistor string.

13. The gamma-reference-voltage generating circuit of claim 8, further comprising a third thermal compensation section that is coupled between the second resistance string and the third voltage terminal, wherein the third thermal compensation section exhibits a resistance which decreases with an increase of temperatures.

14. The gamma-reference-voltage generating circuit of claim 13, wherein the third thermal compensation section comprises a negative thermistor.

15. The gamma-reference-voltage generating circuit of claim 13, wherein the third thermal compensation section comprises:

a negative thermistor; and a first resistor electrically connected in parallel with the negative thermistor.

16. The gamma-reference-voltage generating circuit of claim 15, wherein the third thermal compensation section further comprises a second resistor connected in series between the third voltage terminal and a common connection between the first resistor and the negative thermistor.

17. An apparatus for generating gamma-voltages comprising:

a gamma-reference-voltage generating circuit comprising:

first and second resistor strings outputting a plurality of gamma-reference-voltages and including a plurality of resistors, the resistors of the first resistor string being connected in series and the resistors of the second resistor string being connected in series; and a first thermal compensation section having a resistance value that varies as a function of temperature, the first thermal compensation section being electrically connected to a first voltage terminal receiving a first voltage and to a first end of the first resistor string; and a gamma-voltage outputting section having values in a first range coupled to the gamma-reference-voltage generating circuit, the gamma-voltage outputting section outputting a plurality of gamma-voltages in response to receipt of a plurality of the gamma-reference-voltages from the gamma-reference-voltage generating circuit wherein the first and second resistor strings and the first and second thermal compensation sections are connected to each other in series.

18. The apparatus of claim 17, wherein the first thermal compensation section comprises a thermistor.

19. The apparatus of claim 17, further comprising a second thermal compensation section having a resistance that varies according to the temperature, the second thermal compensation section being electrically connected to a second voltage terminal receiving a second voltage and to the second resistor string and outputting gamma-reference-voltages having values in a second, different range.

20. The apparatus of claim 17, further comprising a third voltage terminal for receiving a third voltage, the third voltage terminal being coupled to a common terminal between the first resistor string and the second resistor string.

21. A display device comprising:

a display panel;

a timing control section receiving a first image signal and a first synchronization signal, and outputting a second image signal, a second synchronization signal and a third synchronization signal based on the first image signal and the first synchronization signal;

a data driver outputting a data signal to the display panel based on the second image signal and the second synchronization signal;

a gate driver outputting a gate signal to the display panel based on the third synchronization signal; and a gamma-reference-voltage generating section generating a plurality of gamma-voltages, and providing the data driver with the gamma-voltages, wherein the gamma-reference-voltage generating section comprises, a plurality of resistor strings including a plurality of resistors and outputting a plurality of gamma-reference-voltages, and a thermal compensation section having a resistance value that varies according to the temperature, the thermal compensation section electrically connected to a source voltage terminal that is provided a source voltage and the resistor that outputs the gamma-reference-voltages corresponding to a high gradation, wherein the resistors of the resistor strings are connected in series and the resistor strings and the thermal compensation sections are connected to each other in series.

* * * * *